US006604323B1

(12) United States Patent
Joo

(10) Patent No.: US 6,604,323 B1
(45) Date of Patent: Aug. 12, 2003

(54) COMPOSITE WINDOW FRAMEWORK FABRICATED USING RECYCLED STYRENE FOAM PANELS

(76) Inventor: Boo Don Joo, 305-1003, Tapmaeul Ssang Yong, Apt. 511, Yatap-dong, Pundang-ku, Sungnam-si, Kyungki-do (KR), 463-070

( * ) Notice: Subject to any disclaimer, the term of this patent is extended or adjusted under 35 U.S.C. 154(b) by 0 days.

(21) Appl. No.: 10/018,824

(22) PCT Filed: Jun. 20, 2000

(86) PCT No.: PCT/KR00/00648

§ 371 (c)(1),
(2), (4) Date: Dec. 21, 2001

(87) PCT Pub. No.: WO00/79087

PCT Pub. Date: Dec. 28, 2000

(30) Foreign Application Priority Data

Jun. 22, 1999 (KR) ..... 1999/23616

(51) Int. Cl.[7] ..... E05D 15/48; E06B 7/16; E06B 3/00

(52) U.S. Cl. ..... 49/163; 49/406; 49/490.1; 52/204.5

(58) Field of Search ..... 52/204.5, 786.1, 52/786.11; 49/406, 163, 501, 475.1, 161, 61, 62, 63, 490.1

(56) References Cited

U.S. PATENT DOCUMENTS 4,302,262 A * 11/1981 Kay ..... 49/475.1 X
4,558,536 A 12/1985 Dunsmoor
4,922,656 A * 5/1990 Giguere ..... 49/161
5,566,507 A * 10/1996 Schmidt et al. ..... 49/428
6,122,864 A * 9/2000 Martin ..... 49/475.1 X
6,256,931 B1 * 7/2001 Kenkel et al. ..... 49/450

FOREIGN PATENT DOCUMENTS

JP 50-21793 7/1975
JP 61-295028 12/1986

* cited by examiner

*Primary Examiner*—Alvin Chin-Shue
*Assistant Examiner*—Hugh B. Thompson
(74) *Attorney, Agent, or Firm*—Jagtiani + Guttag

(57) ABSTRACT

The object of this invention is to provide a composite window framework fabricated using recycled styrene foam panels. This window framework consists of a window frame (30) and one or more movable sashes (12). Each of the window frame (30) and the movable sashes (12) consists of an aluminum outside panel (45), (25) and an insulation inside panel (35), (15). The inside panel (35), (15) is produced using recycled styrene foam through an extrusion process. A magnet (5) is set on the facing surfaces of the sashes (12) so as to allow the windows (10) and (10') to be magnetically attracted to each other while accomplishing a desired sealing effect at the junction between them when the windows are closed. This window framework accomplishes a desired soundproofing and insulating effect, and is less likely to be decayed or deformed due to moisture or temperature differences between the outdoor and indoor environments.

1 Claim, 3 Drawing Sheets

COMPOSITE WINDOW FRAMEWORK FABRICATED USING RECYCLED STYRENE FOAM PANELS

TECHNICAL FIELD

The present invention relates, in general, to a composite window framework fabricated using different materials and, more particularly, to a composite window framework fabricated using aluminum outside panels and insulation inside panels formed of recycled styrene foam through an extrusion process, thus accomplishing both a desired soundproofing effect and a desired thermal insulating effect and being less likely to be decayed, distorted or deformed irrespective of atmospheric moisture or temperature differences between the indoor and outdoor environments, and thereby having a high operational reliability.

BACKGROUND ART

As well known to those skilled in the art, a window framework typically comprises a window frame fitted in a window opening formed on a wall of a building, and one or more movable sashes set within the window frame and individually containing a pane of glass to form a window. In such window frameworks, each of the window frame and the movable sashes is fabricated using inside and outside panels made of different materials. As disclosed in, for example, Korean U.M. Publication Nos. 92-8096 and 97-3384, each of the window frame and movable sashes of most conventional composite window frameworks is fabricated using aluminum panels and wood panels.

That is, conventional composite window frameworks are fabricated using outside panels made of metal, such as aluminum, capable of somewhat effectively resisting rain, wind or snow, and insulation inside panels made of wood capable of somewhat effectively blocking an undesired transmission of heat from the outside panels into a room in addition to accomplishing a desired soundproofing effect.

However, such wood inside panels of the conventional composite window frameworks are poor in their workability, and productivity during a process of manufacturing the composite window frameworks is low.

In addition, the inside panels made of wood are apt to be easily decayed, distorted or deformed due to atmospheric moisture and temperature differences between the indoor and outdoor environments. In such a case, it is very difficult for users to move the sashes within the window frames. Such decay, distortion or deformation of the wood inside panels due to both atmospheric moisture and temperature differences also allows a formation of undesired gaps between the windows and between the window frame and the windows. This finally reduces both the thermal insulating effect and the soundproofing effect of the window frameworks.

DISCLOSURE OF THE INVENTION

Accordingly, the present invention has been made keeping in mind the above problems occurring in the prior art, and an object of the present invention is to provide a composite window framework, which is fabricated using aluminum outside panels and insulation inside panels formed of recycled styrene foam through an extrusion process, thus accomplishing both a desired soundproofing effect and a desired thermal insulating effect and being less likely to be decayed, distorted or deformed irrespective of atmospheric moisture or temperature differences between the indoor and outdoor environments, and thereby having a high operational reliability, and which is improved in productivity during a process of manufacturing the window frameworks.

Another object of the present invention is to provide a composite window framework, which is designed to optimally reduce the gap between the windows, thus improving the thermal insulating effect and the soundproofing effect of the windows.

In order to accomplish the above object, the present invention provides a composite window framework, comprising a window frame fitted in a window opening formed on a wall of a building, and two movable sashes set within the window frame and individually containing a pane of glass to form a window, with a magnet set on the inside surface of each of the two windows to allow the two windows to be magnetically attracted to each other while accomplishing a desired sealing effect at the junction between the two windows, each of the window frame and the movable sash consisting of an aluminum outside panel and an insulation inside panel produced using recycled styrene foam through an extrusion process.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
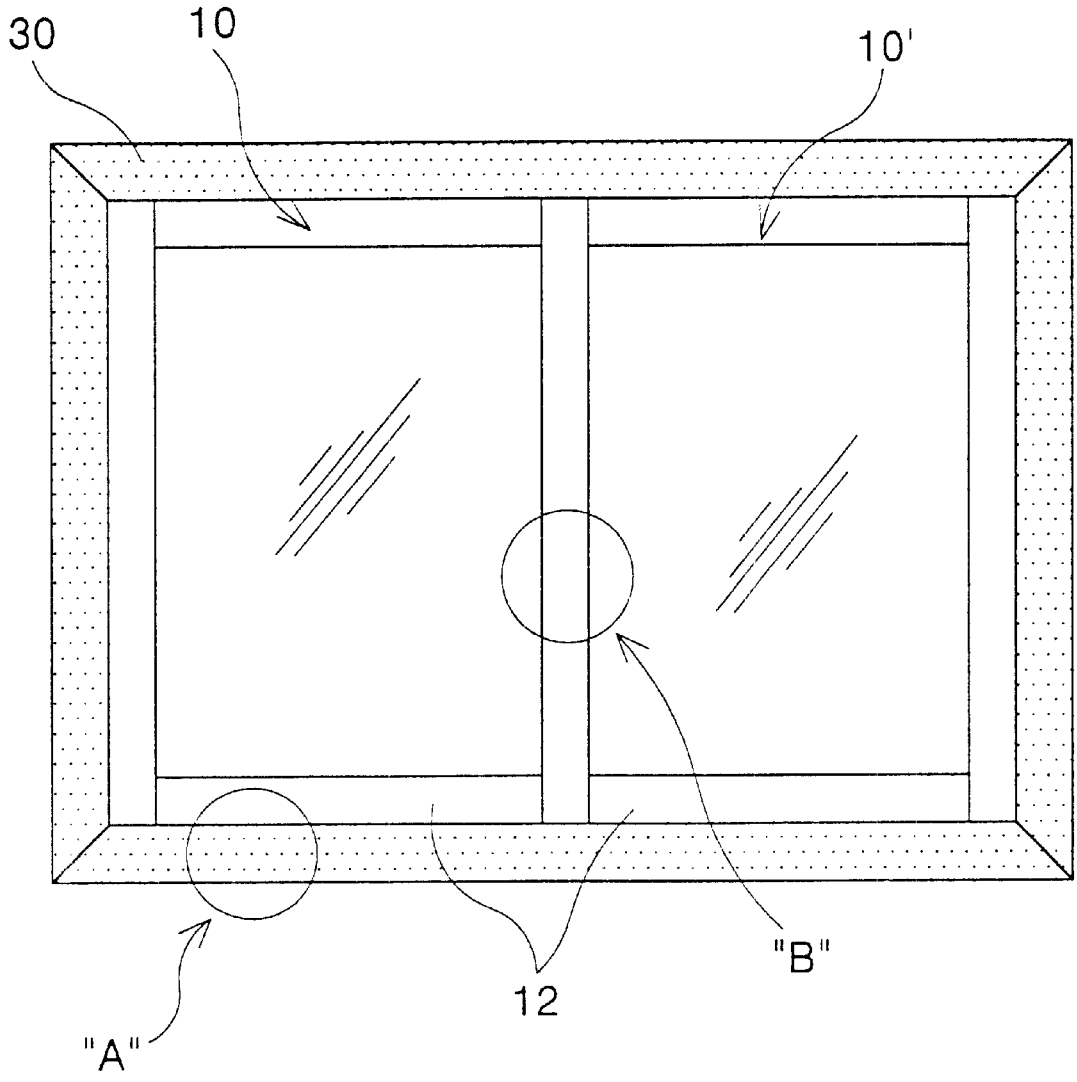
FIG. 1 is a front view of a composite window framework fabricated using recycled styrene foam panels in accordance with the preferred embodiment of the present invention.

Reference should now be made to the drawings, in which the same reference numerals are used throughout the different drawings to designate the same or similar components.

Figure 2:
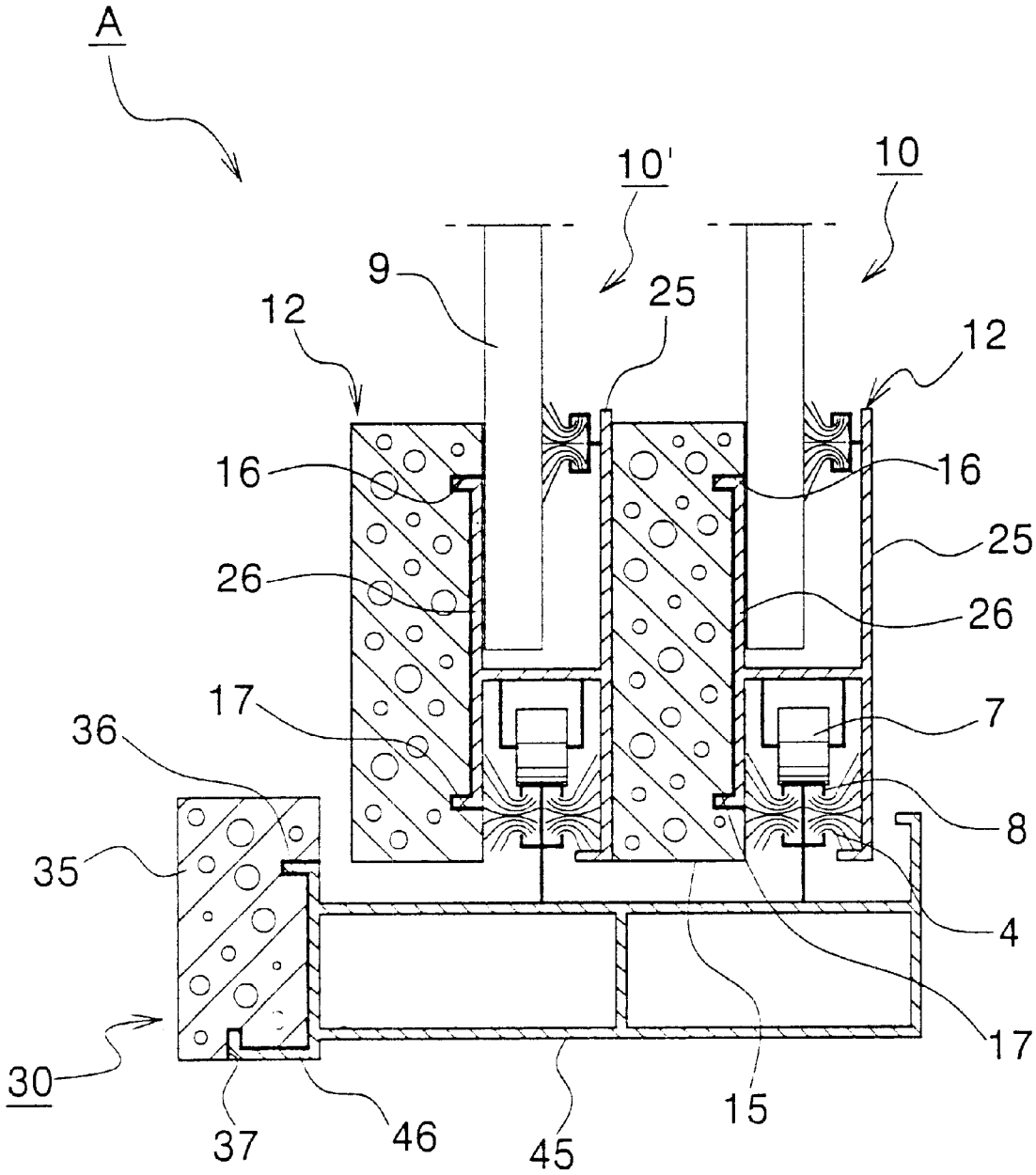
FIG. 2 is a sectional view of the portion "A" of the composite window framework shown in FIG. 1.
Figure 3:
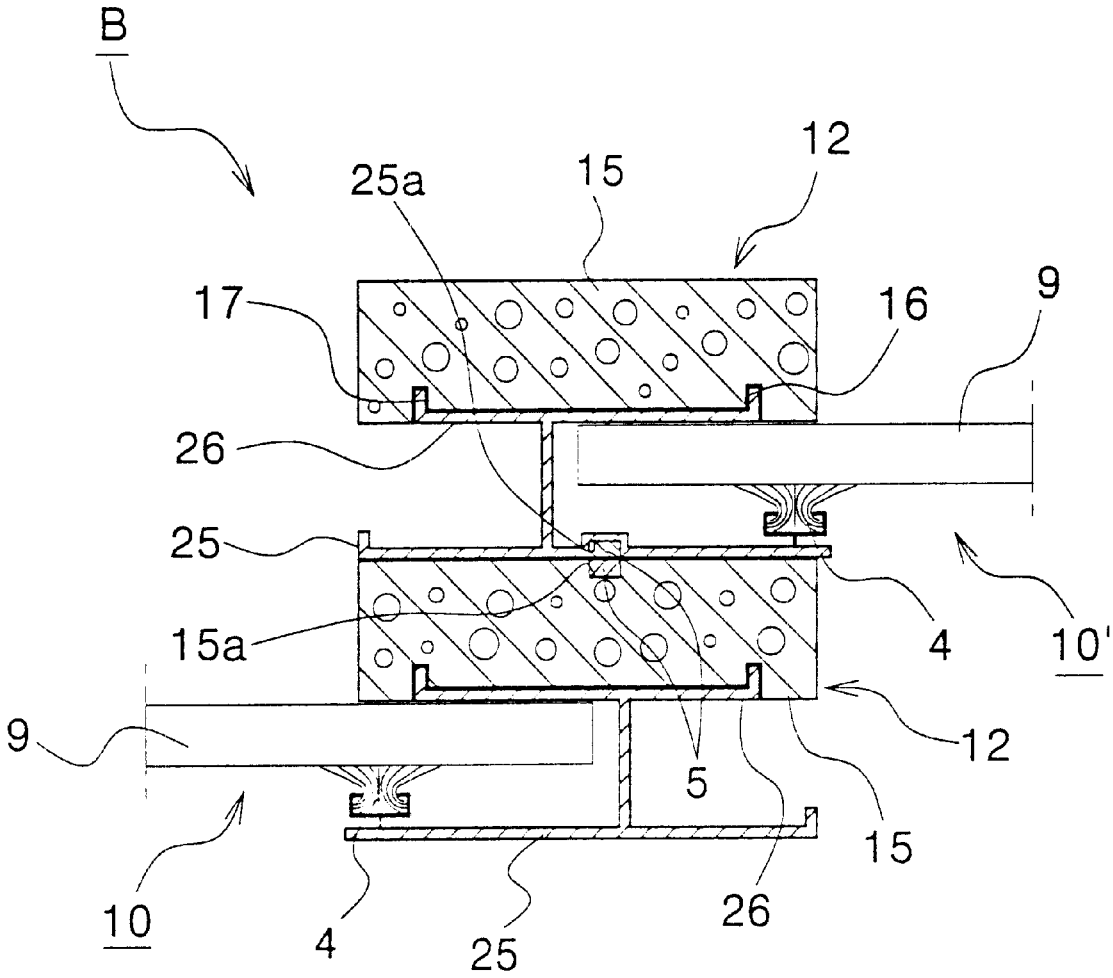
FIG. 3 is a sectional view of the portion "B" of the composite window framework shown in FIG. 1.

FIGS. 1 to 3 are views of a composite window framework fabricated using recycled styrene foam panels in accordance with the preferred embodiment of the present invention. As shown in the drawings, the composite window framework of this invention comprises one window frame 30 and two movable sashes 12. The window frame 30 is fitted in a window opening formed on a wall of a building, while the two movable sashes 12 are set within the window frame 30 and contain panes of glass to form two windows 10 and 10'.

In the composite window framework of this invention, each of the two movable sashes 12 and the window frame 30 consists of an aluminum outside panel 25 or 45, and an insulation inside panel 15 or 35 produced using recycled styrene foam through an extrusion process.

In each movable sash 12, the insulation inside panel 15 has two longitudinally and parallely formed fitting grooves 16 and 17 on its inside surface, while the aluminum outside panel 25 is provided with a longitudinally channeled fitting rail 26 having a ⊔-shaped cross-section as shown in FIG. 3. The above fitting rail 26 closely engages with the two fitting grooves 16 and 17 of the inside panel 15 at its opposite flanges while covering the inside surface of the inside panel 15 between the two fitting grooves 16 and 17, thus firmly assembling the inside and outside panels 15 and 25 into a desired single sash 12.

On the other hand, the insulation inside panel 35 of the window frame 30 has a longitudinal fitting groove 36 or 37 on each of two neighboring surfaces thereof. The aluminum outside panel 45 of the window frame 30 is provided with a longitudinally channeled fitting rail 46 having an open-cornered rectangular cross-section designed to closely engage with the two fitting grooves 36 and 37 of the inside panel 35 at its opposite flanges while covering an angled surface of the inside panel 35 between the two fitting grooves 36 and 37 as shown in FIG. 2. The inside and outside panels 35 and 45 of the window frame 30 are thus firmly assembled into a desired single window frame.

During the process of manufacturing the composite window framework of this invention, the inside and outside panels 15 and 25 of each sash 12 and the inside and outside panels 35 and 45 of the window frame 30 may be assembled with each other by compressing them or by using separate locking members.

In addition, two magnet fitting grooves 15*a* and 25*a* are vertically formed along the facing surfaces of the inside and outside panels 15 and 25 of each sash 12, while a magnet 5 is set within each of the two magnet fitting grooves 15*a* and 25*a* as shown in FIG. 3. Therefore, when the two windows 10 and 10' are completely closed, the two magnets 5 allow the two windows 10 and 10' to be magnetically attracted to each other while minimizing the gap at the junction between the two windows 10 and 10' and accomplishing a desired sealing effect at that junction.

In the drawings, the reference numeral 9 denotes glass panels of the windows 10 and 10', and the numeral 4 denotes a sealing material used for accomplishing the soundproofing effect and the thermal insulating effect of the window framework in addition to preventing an undesired introduction of dust or rain into a room through the window framework. On the other hand, the reference numeral 7 denotes rollers of the windows 10 and 10' rolling along the rails 8 of the window frame 30.

The operational effect of the composite window framework of this invention will be described herein below.

In order to assemble each movable sash 12, the aluminum outside panel 25, provided with the longitudinally channeled fitting rail 26 having a ⊔-shaped cross-section, is locked to the insulation inside panel 15 by closely fitting the fitting rail 26 of the outside panel 25 into the two fitting grooves 16 and 17 of the inside panel 15 while covering the inside surface of the inside panel 15 between the two fitting grooves 16 and 17. Therefore, the inside and outside panels 15 and 25 are easily and firmly assembled into a desired single sash 12, with a pane of glass 9 being set within each sash 12 to form a window 10 or 10'.

On the other hand, the assemblage of the window frame 30 is accomplished by closely fitting the longitudinally channeled fitting rail 46 of the outside panel 45 into the longitudinal fitting grooves 36 of 37 of the insulation inside panel 35. Therefore, the inside and outside panels 35 and 45 are easily and firmly assembled into a desired single window frame 30.

After completely assembling both the window frame 30 and the two windows 10 and 10', the two windows 10 and 10' are movably set within the window frame 30. In such a case, the rollers 7 of the windows 10 and 10' are seated on the rails 8 of the window frame 30.

As described above, the outside panel 25 or 45 of each of the movable sashes 12 and the window frame 30 is made of aluminum, while the insulation inside panel 15 or 35 is formed of recycled styrene foam through an extrusion process.

Since the insulation inside panels 15 and 35 of the composite window framework of this invention are produced using the recycled styrene foam through an extrusion process, it is possible to desirably improve productivity while producing the inside panels 15 and 35 in comparison with conventional wood inside panels.

Furthermore, different from the conventional wood inside panels, the insulation inside panels 15 and 35 made of recycled styrene foam effectively block a transmission of heat from the aluminum outside panels 25 and 45 into the room through the window. In addition, the insulation inside panels 15 and 35 made of the recycled styrene foam are less likely to be decayed, distorted or deformed irrespective of atmospheric moisture or temperature differences between the indoor and outdoor environments, but effectively keep their original shapes for a lengthy period of time.

This finally allows a user to always smoothly and easily move the sashes 12 within the window frame 30, when it is desired to open or close the windows 10 and 10', without leaving any gap between the windows 10 and 10'.

In the composite window framework of this invention, the two magnet fitting grooves 15*a* and 25*a* are vertically formed along the facing surfaces of the inside and outside panels 15 and 25 of each sash 12, with a magnet 5 set within each of the two magnet fitting grooves 15*a* and 25*a*. Therefore, the two magnets 5 allow the two windows 10 and 10' to be magnetically attracted to each other while minimizing the gap between the two windows 10 and 10' and accomplishing a desired sealing effect at that junction, when the two windows 10 and 10' are completely closed.

INDUSTRIAL APPLICABILITY

As described above, the present invention provides a composite window framework, comprising one window frame and one or more movable sashes. In the composite window framework, each of the window frame and the movable sashes is fabricated using an aluminum outside panel and an insulation inside panel produced using recycled styrene foam through an extrusion process. Since the insulation inside panels of this invention are produced using the recycled styrene foam through an extrusion process as described above, it is possible to remarkably improve productivity and to reduce the production cost during a process of manufacturing the composite window framework. Such insulation inside panels are also improved in their thermal insulating effect in addition to the soundproofing effect.

In addition, due to the insulation inside panels made of the recycled styrene foam, the composite window framework of this invention is less likely to be decayed, distorted or deformed irrespective of atmospheric moisture or temperature differences between the indoor and outdoor environments, thereby allowing users to smoothly move the windows when it is desired to open or close the windows. This finally improves the operational reliability of the windows.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A composite window framework, comprising:

a window frame (30) fitted in a window opening formed on a wall of a building, said window frame (30) consisting of an aluminum outside panel (45) and an insulation inside panel (35) produced using recycled styrene foam through an extrusion process, said insulation inside panel (35) of the window frame (30) having a longitudinal fitting groove (36) or (37) on each of two neighboring surfaces thereof, and said aluminum outside panel (45) being provided with a longitudinally channeled fitting rail (46) having an open-cornered rectangular cross-section designed to closely engage with the two fitting grooves (36) and (37) of the inside panel (35) at its opposite flanges while covering an angled surface of the inside panel (35) between the two fitting grooves (36) and (37); and a movable sash (12) set within said window frame (30) and containing a pane of glass to form a window (10) or (10'), said movable sash (12) consisting of an aluminum outside panel (25) and an insulation inside panel (15) produced using recycled styrene foam through an extrusion process, said insulation inside panel (15) of the movable sash (12) having two longitudinally and parallely formed fitting grooves (16) and (17) on its inside surface, and said aluminum outside panel (25) being provided with a longitudinally channeled fitting rail (26) having a ⊔-shaped cross-section, and closely engaging with the two fitting grooves (16) and (17) of the inside panel (15) at its opposite flanges while covering the inside surface of the inside panel (15) between the two fitting grooves (16) and (17).

* * * * *